United States Patent [19]

Hulse

[11] 3,955,708

[45] May 11, 1976

[54] EASY-OPENING PULL TAB TYPE CAN WITH RETAINED TAB

[76] Inventor: Murlin L. Hulse, Rte. No. 1 M-62, Cassopolis, Mich. 49031

[22] Filed: June 17, 1974

[21] Appl. No.: 479,838

Related U.S. Application Data

[62] Division of Ser. No. 241,653, April 6, 1972, Pat. No. 3,820,681.

[30] Foreign Application Priority Data

Apr. 5, 1973 Italy ..... 49263/73

[52] U.S. Cl. ..... 220/269

[51] Int. Cl.[2] ..... B65D 41/32

[58] Field of Search ..... 220/268, 269; 215/7

[56] References Cited

UNITED STATES PATENTS 3,160,302 12/1964 Chaplin ..... 215/7 X

*Primary Examiner*—George T. Hall

*Attorney, Agent, or Firm*—Leo J. Aubel

[57] ABSTRACT

The present disclosure pertains to a novel score-line construction for easy-opening pull tab type cans, as well as a method for forming said score-line. In this regard, the score-line is disposed closely adjacent to the rim of the container end portion, and includes a substantially perpendicular outer peripheral wall. This arrangement provides, upon formation, a zone of compacted material immediately below the base wall surface of said score-line, which zone has an outer peripheral edge that terminates abruptly and substantially in alignment with the aforementioned perpendicular outer wall surface. Accordingly, upon opening, the path of fracture will follow said outer peripheral wall and be substantially coextensive with the edge of said zone, precluding erratic fracturing of said score-line and the formation of relatively sharp burrs. In addition, there are disclosed several novel can end element constructions for a container of the type described, employing a score-line terminating at spaced locations on a debossed area formed in the end portion. Fracture of the score-line will continue until the debossed area is reached, and thereafter further application of opening force will cause the displaceable panel section defined by the score-line to be bent upwardly about said debossed area. Accordingly, access to the can interior can be had, while the displaceable panel section remains connected to the can proper.

4 Claims, 19 Drawing Figures

EASY-OPENING PULL TAB TYPE CAN WITH RETAINED TAB

This is a division of application Ser. No. 241,653, filed on Apr, 6, 1972, now U.S. Pat. No. 3,820,681.

BACKGROUND OF INVENTION

The present invention pertains to easy opening pull tab cans or containers, that is, those including an end portion having a displaceable panel portion defined by a frangible score-line. More specifically, said invention is concerned with novel end and score-line constructions, and methods of fabricating same which obviate many of the problems inherent with the prior art structures.

The easy openings, pull tab type of can has gained wide acceptance by the beverage industry and food processors. In this regard, the container end or end portion is provided with a removable panel to which the pull tab is attached. During opening, the shearing action takes place about a closed loop so that the entire panel is removed to provide an access opening.

Food processors have adopted the easy opening-type of can for use with a wide assortment of products, primarily in the area of snack foods such as nuts, prepared puddings, fruits, meat products, and the like. With these uses, the removable panel section is quite large, generally encompassing all but the outer perimeter of the can and providing a relatively wide opening.

The adoption of the easy opening can has not been totally without problems. In the packaging of snack foods there have been an alarming number of instances wherein consumers have sustained injury due to the relatively sharp edges remaining on the rim and of the container and the panel section after removal of said panel section. This problem has become especially serious with regard to prepared puddings and fruits, quite popular with school age children who have been known to attempt to lick the interior of the container and/or the panel section, and as a result thereof have suffered serious cuts to their tongues and lips. In fact, many schools have requested that parents refrain from using this type of container because of its inherent danger. The danger of injury is not limited to children, as careless adults have also suffered severe cuts.

The beverage type of easy opening can has also been the cause of numerous injuries. Children, overcome by curiosity have sustained injury to their tongues and fingers when attempting to insert these within the relatively narrow key hole opening. In addition, the removable panel sections are often discarded and as such, become the source of danger to anyone who is barefoot. The problem is especially acute in beach areas wherein the discarded panels often lie submerged in the sand.

With the present invention, the problems and dangers inherent in the prior art easy opening containers are obviated. As will be explained more completely hereinafter, there is employed an overall score-line construction and method of fabrication which assures that both the edge of the end portion opening and that of the displaceable panel section are relatively smooth and free from any burrs or protuberances which could cause injury. In addition, there is provided an end portion construction which permits retention of a displaced of fractured panel section so that said panel section cannot be discarded and will be disposed of along with the can itself.

DESCRIPTION OF THE ILLUSTRATED EMBODIMENTS

Figure 1:
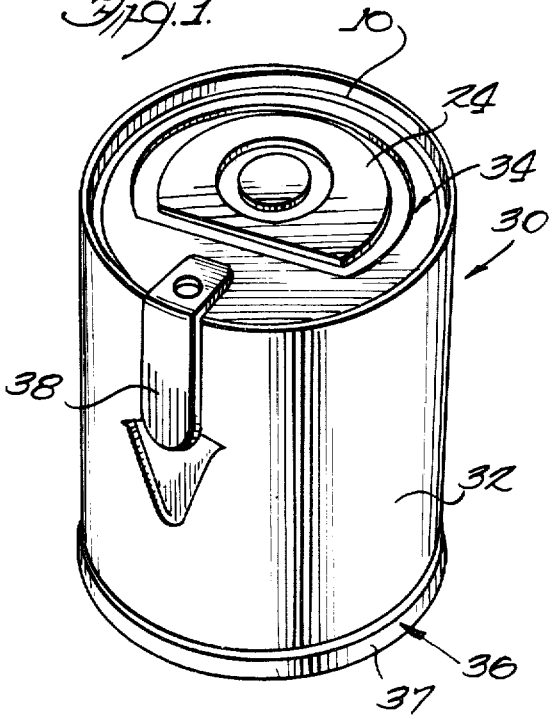
FIG. 1 is a perspective view of a drawn metal container embodying the score-line construction of the present invention.

In order to fully appreciate and understand the present invention, it is necessary first to consider the general construction of prior art containers and those factors which attribute to their potential danger. First of all, each easy opening pull tab container includes an end portion that may be formed from a separate end element attached to the can body by a rolled seam or formed unitarily with the body section as illustrated in the drawings. In either case, the end portion is scored to provide a frangible wall section termed the "score-line," which defines the shape of the removable panel section. Where the panel sections are completely removed, the score-line will traverse a closed loop.

Figure 6:
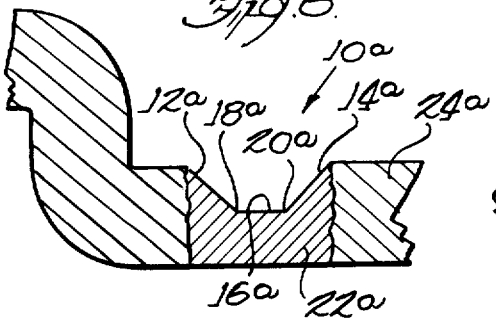
FIG. 6 is a fragmentary sectional view of a container end portion having a score-line formed in accordance with the prior art practices, embossed therein.
Figure 7:
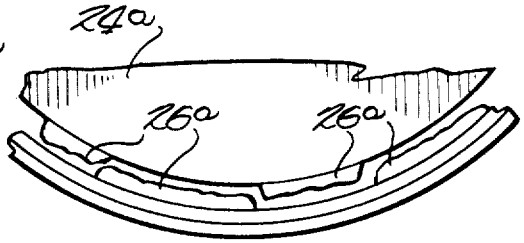
PRIOR ART Fig. 7.
FIG. 7 is a partial elevational view illustrating the manner of fracture for the prior art score-line constructions.

With reference to FIGS. 6 and 7, the prior art score-line constructions, and the problems occasioned thereby will first be considered. In this regard, the scoring operation is generally achieved using a scoring punch which displaces the material of the end portion to form a groove having a base wall section of reduced thickness. The prior art form of score-line 10*a* is illustrated specifically in FIG. 6 and as can be seen, employs inwardly sloping sidewall surfaces 12*a* and 14*a* and a generally horizontally base wall surface 16*a* which meet to define inner and outer peripheral corners 18*a* and 20*a*. During opening the frangible base wall section 22*a* will fracture, preferably at one or the other of the peripheral corners 18*a* or 20*a*. In practice, however the path that the fracture follows is an erratic one, following one of the peripheral corners for a distance and then traversing the base wall surface 16*a* to the opposite corner, which may happen several times during opening. As a result thereof, when the panel section 24*a* is removed or displaced, as illustrated in FIG. 7, the peripheral edges of the panel section and the rim of the opening provided in the end portion will include ragged protuberances or burrs 26*a* formed by the aforementioned erratic fracturing of the base wall 22*a*. It is these protuberances or burrs 26*a* which are the source of injury as the radial edges thereof are sufficiently sharp to inflict a severe cut.

These problems inherent with prior art constructions are overcome by the present invention. Primarily, this is achieved by the provision of a novel score-line construction and method of fabrication, which assures elimination of the burrs 26*a*. In addition there is provided a novel can construction which permits the retention of the panel section with the main can body for disposal therewith.

Consideration will now be directed to the present invention, and initially to FIG. 1. In FIG. 1, there is illustrated one type of form of can 30 uniquely suited for employment with the present invention. In this regard, the can 30 includes a cylindrical body section 32, an upper end portion 34 and a lower end portion 36. With the illustrated embodiment, the upper end portion 34 is formed as a unitary element with the body section 32, the lower end portion 36 being in the form of a separate element attached to the body section 32 by a rolled seam 37 or the like.

Figure 2:
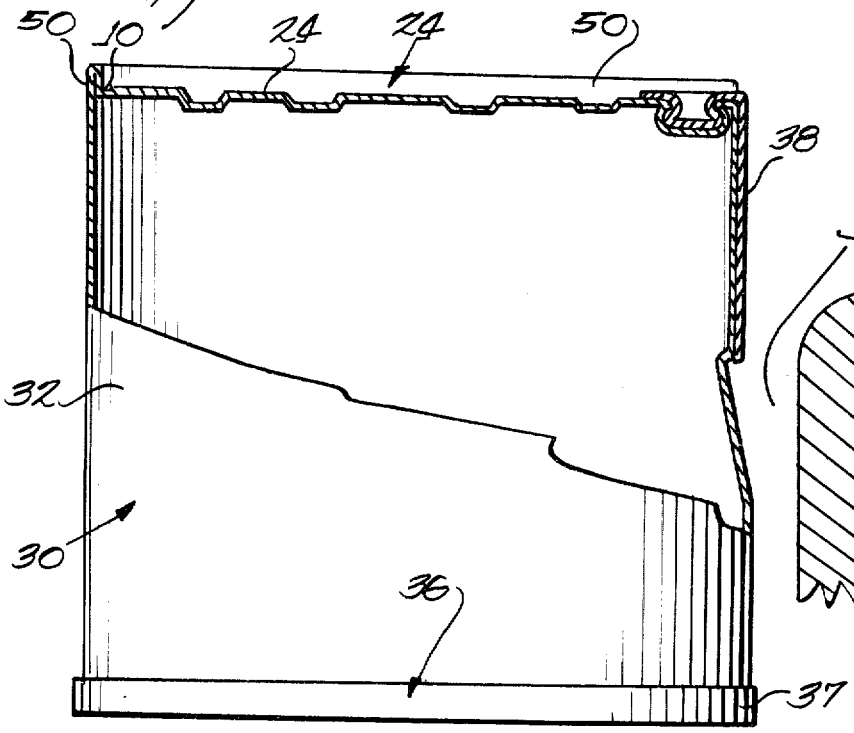
FIG. 2 is a partial sectional view of the container of FIG. 1.

The upper end portion 34 is provided with a circular score-line 10, best viewed in FIG. 2, which defines a removable panel portion 24. Attached to the removable panel portion 24 is a pull tab opening device 38. When the pull tab opening device 38 is grasped and pulled upwardly, initial fracture or breaking of the score-line 10 will be produced. Upon the application of continued force by means of the pull tab device 38, the complete fracture of the score-line 10 can be obtained and the panel portion 24 removed from the can.

The general construction of the can 30 is similar to that of applicant's prior U.S. Pat. No. 3,302,823, and references may be had to said patent for a more complete description thereof, if desired.

Figure 3:
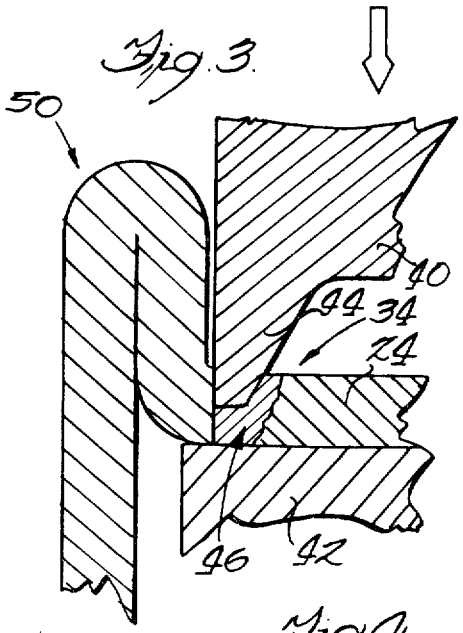
FIG. 3 is a fragmentary sectional view on an enlarged scale, of the container end portion, illustrating the manner in which the score-line is formed therein, by a scoring punch.
Figure 4:
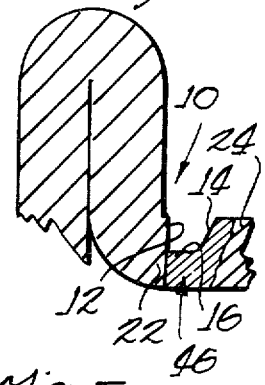
FIG. 4 is a fragmentary sectional view of the container end portion after the score-line has been formed therein.
Figure 5:
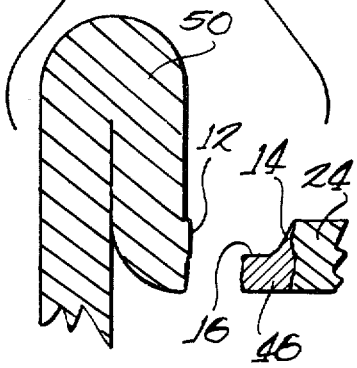
FIG. 5 is a fragmentary sectional view illustrating the manner of fracture of the score-line.

Attention is now directed to FIGS. 3 and 5 which illustrate the features of the present invention on a somewhat enlarged scale. In FIG. 3, the manner of forming the score-line 10 is illustrated, while the sectional profile of the score-line 10, subsequent to forming is illustrated in FIG. 4, the fractured condition for said score-line 10 being illustrated in FIG. 5.

FIG. 3 illustrates schematically the accepted or commercial manner of forming the score-line 10, which is to employ an upper punch 40 and a lower support element 42. The punch 40 includes an annular die section 44 shaped as illustrated which upsets the metal of the container end portion 34 to form the score-line 10. The lower support element 42 is relatively flat and provides support or backing for the material of the container end portion 34 during scoring and prevents downward displacement of the material.

The profile or shape of the resulting score-line 10 attained with the punch 40 and the die 44, is illustrated in FIG. 4. As can be seen, the score-line 10 includes an outer peripheral side wall 12 which is generally perpendicular to the upper surface of the container end portion 34, while the inner peripheral side wall 14 is disposed on an angle. The base wall surface, designated 16, is generally horizontal and perpendicular to the side wall 12. Quite clearly, the shape of the die 44 is complementary to that of the profile of the score-line 10, in order to produce the desired configuration. The importance of the configuration thus described, will be apparent from the hereinafter detailed description.

More specifically, the operation of the die 44 on the container end portion 34 in forming the score-line 10 is a cold working process. Due to the presence of the lower support member 42, the metal is not displaced downwardly, but is compacted in the area or region of the base wall section of the score-line, which section is designated generally 22. This compacting produces a work hardening of the metal and correspondingly a zone of relatively brittle material, designated 46 and illustrated by the shaded area of wall section 22 in FIGS. 3 and 4. The zone of compacted material 46 terminates abruptly on its outer periphery generally in alignment with the side wall 12. This feature is attained due to the shape of the die 44 and the fact that the side wall 12 is formed generally perpendicular, rather than on a bias as is the case with prior art constructions. Were the side wall surface 12 constructed as per the prior art, the zone of compacted material would assume a rather indefinite and irregular shape, as illustrated by the shaded area of Fig. 6 (the prior art construction).

Figure 17:
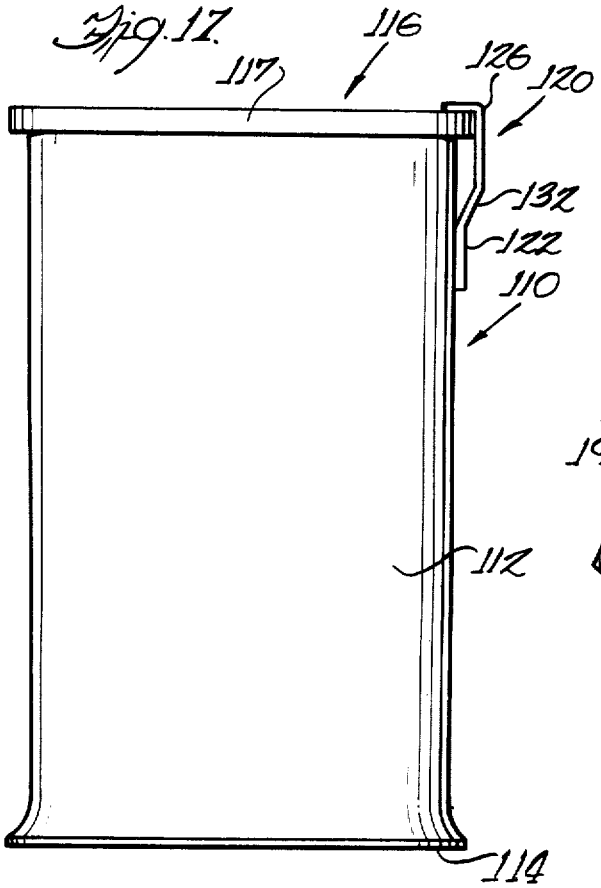
FIG. 17 is an elevational view of a novel container construction employable with the various features and modifications illustrated previously.

It should be noted, that the above-mentioned scoring of the can end portion 34 takes place prior to assembly of the pull tab member 38. In instances wherein the can end portion is a separate element of the container construction, as illustrated in FIG. 17, the score-line 10 will be formed therein prior to attachment to the can body 32.

An additional important feature of the disclosed embodiment of the present invention is the employment of the rim 50 and its relationship to the score-line 10. The rim 50 extends about the entire periphery of the can end portion 34 and is in the form of a return-bend portion. As such, the rim 50 provides relatively stiff support for the material disposed radially outward of the score-line 10. The score-line 10 is positioned as close to rim 50 as is physically possible, a feature which is achieved only by employment of the relatively perpendicular side wall 12, and the complementary shaped portion of the die 44. It should be noted that if a tapered wall were employed, the score-line 10 would have to be displaced somewhat from the rim 50 by a distance equal to the degree of taper. Accordingly, with the disclosed arrangement, the rim 50 renders the material adjacent to and radially outward of the score-line 10 relatively stiff and unflexible as compared to the panel section 24.

With the above discussion in mind, consideration is now directed to the manner in which the base wall section 22 of the score-line 10 fractures during removal of the panel section 24. In this regard, as the pull tab 38 is pulled upwardly, an initial fracture in the base wall section 22 will occur, which fracture takes place at the juncture of the base wall surface 16 and the side wall 12 and will be coextensive with the outer periphery of the work hardened zone 46. This is due to the fact that the material compacted and hardened to form zone 46 terminates abruptly, the periphery thereof being in general alignment with the relatively perpendicular side wall 12. This taken in conjunction with the stiff unyielding nature of the material radially outward of the score-line as provided by the rim 50 and its close proximity to the score-line 10 promotes shearing as indicated.

In effect, there is attained a situation wherein a region of stress concentration exists, i.e., zone 46, which terminates abruptly with the material radially outward thereof being relatively stiff and unyielding. Accordingly, when an upward force is applied to the panel 24, the material will fracture or shear at the edge of this zone 46 and at the above mentioned juncture of wall surfaces 12 and 16, since same represents the weakest portion of the wall section 22 and the path of least resistance to the shearing action. In addition, it should be noted that the employment of the mutually perpendicular side wall 12 and base wall surface 16 provide a notch sensitive area at their juncture, an additional factor which facilitates shearing at this point.

Upon the continued application of opening force by means of the pull tab 38, the path of fracture through the base wall section 22 will continue to follow the outer edge of zone 46 as this represents the path least resistant to the shearing action. Accordingly, the shearing action will continue along the juncture of the aforementioned side wall 12 and base wall surface 16, and will extend through the base wall section 22 coextensive with the edge of the work hardened zone 46. Accordingly, the path of fracture does not traverse across the base wall surface 16 to the tapered side wall 14. Therefore, upon completion of fracture and removal of the panel section 24, the rim or periphery of the opening thus obtained will be relatively smooth and free of sharp burrs, such as the burrs 26*a* occasioned with the prior art construction. Correspondingly, the danger of an individual being injured by running his finger or tongue over the rim of the container opening is materially reduced.

Figure 8:
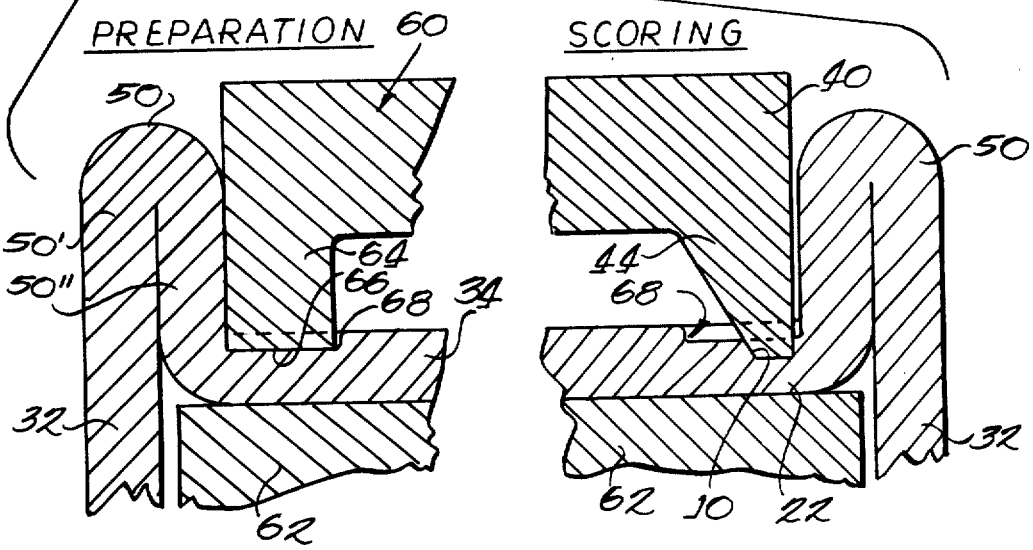
PRIOR ART Fig. 8.
FIG. 8 is a fragmentary sectional view illustrating a novel method of forming a score-line in a container end portion.

While a conventional method for forming a score-line is illustrated and described in FIG. 3, the method of FIG. 8 provides an alternate, novel method of forming a score-line, be it the score-line 10 of FIGS. 1–5 or the prior art type of score-line illustrated in FIGS. 6 and 7. It must be kept in mind however, that this method is especially advantageous when employed with the score-line 10 wherein controlled work hardening is attained.

Recalling the prior discussion of the prior art arrangements and the reasons for erratic fracture of the score-line, an additional factor which was not mentioned is variance in the thickness of the wall section. The thickness of the score-line base wall is also a factor which determines the amount of force that must be applied to effect fracture of said score-line and removal of the panel section.

It must also be kept in mind, that pull tab containers of the type under discussion are often employed for carbonated beverages, and as such the strength of the score-line base section must be sufficient to withstand the internal pressures encountered. In this regard, the strength of the score-line is directly related to the base wall section thickness. Therefore, the tolerances within which the score-line must be maintained are critical.

Considering now FIG. 8, in detail, the formation of the score-line 10 is achieved in two steps. The initial step is a preparation procedure wherein a punch 60 is employed in conjunction with a lower supporting member 62 engaged against the underside of the panel portion 34. The preparation punch 60 includes an annular die section 64 that has a flat lower surface 66. Upon engagement of the panel portion 34 by the punch 60, the material thereof is compressed along a relatively wide annular band 68 conforming to the width of the die surface 66. This compacting produces some degree of work hardening, but most importantly, eliminates any and all dimensional irregularities in the area of the band 68 into which the score-line 10 is to be formed. That is to say, this procedure provides an area of uniform wall thickness for reception of the score-line 10.

The formation of the score-line 10 in the annular band 68 is preferably performed in essentially the same manner as described with regard to FIG. 3. That is a punch 40 having a die 44 is employed. This step of the procedure is illustrated in the right hand portion of FIG. 8.

In this regard, the wall thickness of the annular band 68 is uniform along the entire length thereof. Accordingly, upon formation of the score-line 10, the resulting base wall section 22 will have a closely controlled, uniform thickness along its entire length.

It must be emphasized at this point that while the score-line in FIGS. 3–5 is preferred, the method of FIG. 8 hereinabove described may be employed with conventional score-lines, such as 10*a*, of FIG. 6.

In addition, the die 64 may be sized to insure that the respective sections 50' and 50'' of the return bend rim 50 are forced into close abutting engagement. Also, the outer peripheral edge of the die 64 will form an abrupt corner at the inner section of the horizontal surface of the panel 34 in the upwardly extending rim section 50'', which facilitates placement of the score-line 10 in close proximity to said rim 50.

In FIGS. 9–13, an alternate, novel construction for a container is illustrated. The various container end portion constructions illustrated in these figures were designed to eliminate the problems encountered with the prior art types wherein the removable panel portion is completely separated from the end portion and then discarded. That is to say, in the three embodiments illustrated the container may be opened with the panel portion remaining connected to the container end portion for subsequent disposal in conjunction with the container body.

Figure 9:
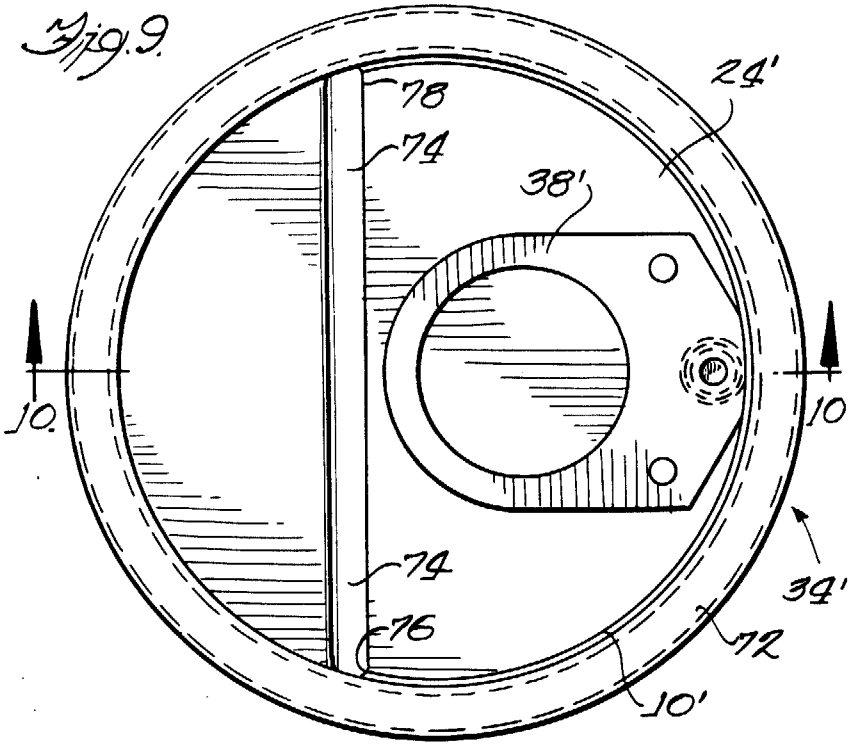
FIG. 9 is a top plane view of a separable container end portion formed with a debossed area which precludes separation of the panel portion from the container end portion, which will permit access to the interior of the container.
Figure 10:
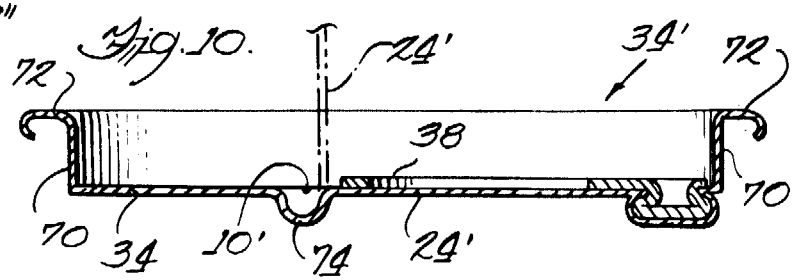
FIG. 10 is a sectional view taken along the lines 10—10 of FIG. 9.

Turning first to FIGS. 9 and 10, there is illustrated an end portion construction 34' of the type formed as a separate element and subsequently engaged with a container body section. In this regard, the end portion 34' includes an upwardly extending rim 70 which has a curled lip 72 formed thereon which can be engaged with a can body section by the well-known process of roll-seaming.

A score-line 10' is formed in the upper surface of the panel portion 34' in relative close proximity to the rim 70. While it is preferred that a score-line construction as discussed previously with regard to FIGS. 3–5 be utilized with the end portion FIGS. 9–13, this is not necessary and prior art score-lines may be used, if desired.

Returning now to the construction of FIGS. 9 and 10, it should be noted that the score-line 10' does not completely encircle the end portion 34', but rather terminates at spaced locations. More specifically, a debossed area 74 is provided at the upper surface of the panel portion 34' with the terminal points 76 and 78 of the score-line 10' being at the periphery of said debossed area 74. As such, the score-line 10' and the debossed area 74 define a panel section 24' which is in the shape of a segment of a circle.

Attached to the panel section 24' is a pull tab member 38' of a somewhat different type than that discussed previously. Upon opening, the score-line 10' will be initially fractuared in the area of the point of connection of the tab 38' to the panel section 24'. As the tab 38' is pulled upwardly, the score-line 10' will continue to fracture until the debossed area 74 is reached. After this, the debossed area will resist further random tearing or shearing of the end portion 34', and will function as a fulcrum about which the panel section 24' will be bent upwardly, as illustrated in phantom in FIG. 10. Accordingly, there is provided an access opening to the interior of the container; however, the panel section 24' will be retained in connection with the end portion 34' and will be discarded with the entire container.

Figure 11:
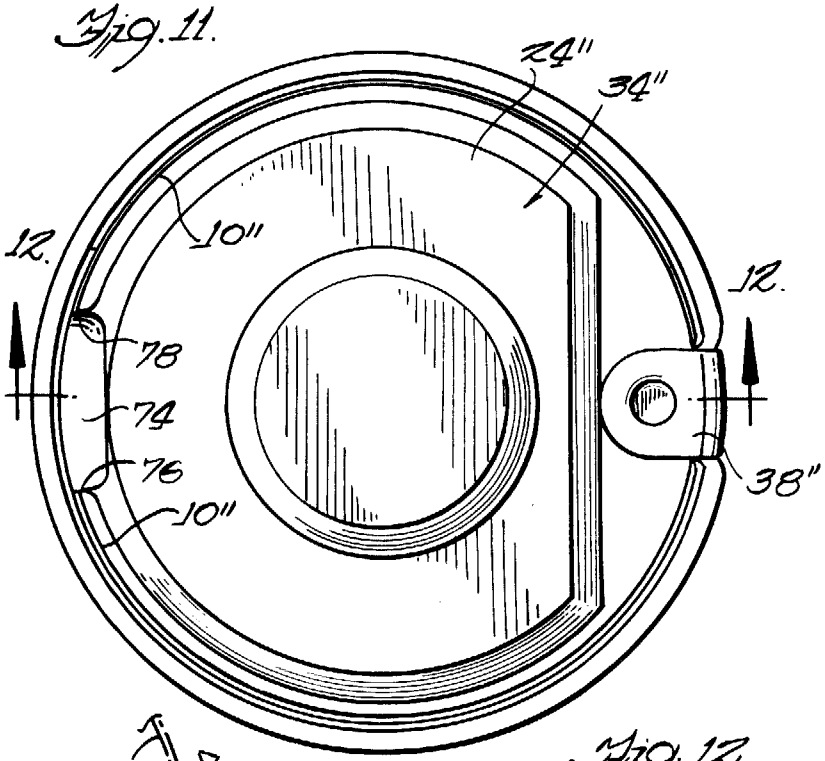
FIG. 11 is a top plane view of a container of the type illustrated in FIG. 1, having an end portion provided with the debossed area for assuring retention of the panel portion subsequent to opening.
Figure 12:
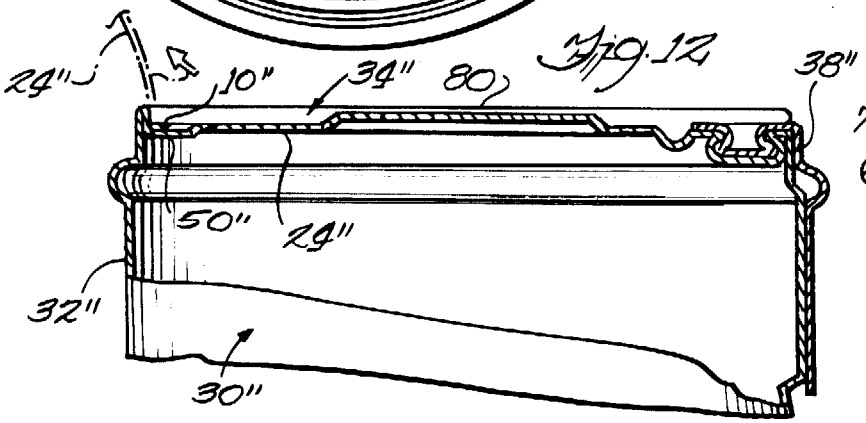
FIG. 12 is a partial fragmentary sectional view taken along the lines 12—12 of FIG. 11.

The embodiment of FIGS. 11 and 12 is quite similar to that as discussed with regard to FIGS. 9 and 10. It should be noted initially, that the container construction of this embodiment is of the type discussed with regard to FIGS. 1–5, wherein the end portion 34'' is formed unitarily with the can body section 32'' of the container. As such, it is possible to use a pull tab device 38'' such as illustrated and discussed with regard to FIG. 1.

Considering now FIG. 11, it can be seen that a debossed area 74 is provided in the upper surface of the end portion 34'' in a position diametrically opposed to the point of connection of the pull tab 38''. As was the case with the embodiment of FIGS. 9 and 10, the score-line 10'' is formed in the container end portion 34'' and extends about the periphery thereof, terminating at spaced points 76 and 78 at the periphery of said debossed area 74. The score-line 10'' and the debossed area 74 of the embodiment of FIGS. 11 and 12 thus define a panel portion 24'' which is more nearly a complete circle than that of the previously discussed embodiment.

Accordingly, upon opening, the score-line 10'' will be fractured with said fracturing continuing until the debossed area 74 is reached. At this point in the opening operation, the continued application of forces will cause the debossed area 74 to operate as a fulcrum about which the panel portion 24'' will be bent upwardly, as illustrated in phantom.

With the embodiment of FIGS. 11 and 12, it should be noted that any tendency in the container material to tear once the debossed area 74 is reached, will produce tearing upwardly along the inner-fold 50'' of the rim rather than across the debossed area 74. This feature becomes significant due to the relatively short length of the debossed area 74, and aids greatly in assuring that the panel portion 24'' will not become disconnected from the remainder of the container.

In addition, it should be noted that the panel portion 24'' may be provided with a dome shaped section 80. This dome shaped section is utilized as an indicator device, in that when a vacuum is created within a container such as is often done with perishable products, the dome will be drawn inwardly. As such, by visually inspecting the container a customer can tell whether the vacuum has been broken or not. That is to say, if the dome 80 is concaved outwardly, the purchaser will know immediately that the vacuum within the container has not been maintained.

Figure 13:
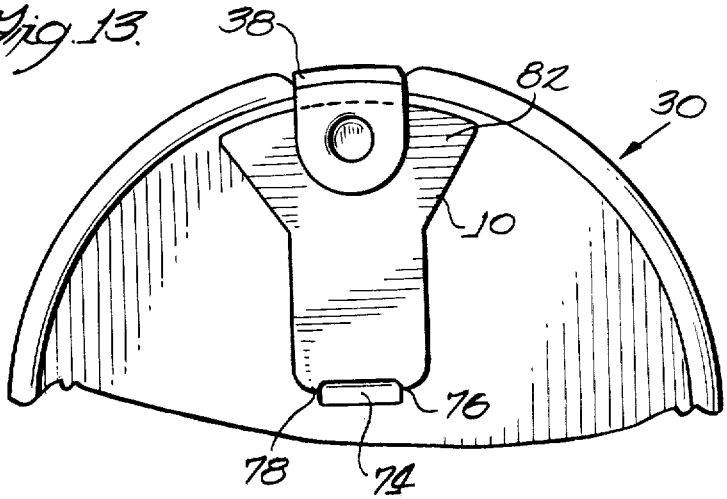
FIG. 13 is a partial top plane view of a container end portion having a keyhole panel and employing a debossed area for preventing removal of said panel.

In the embodiment of FIG. 13, the above discussed invention is employed in conjunction with the keyhole type of panel section, often found on beverage containers. In this regard, the score-line 10, which defines the keyhole panel section 82, also terminates at spaced apart locations 76 and 78 on the periphery of the debossed area 74. During opening, fracture of the score-line will continue as described previously, until the debossed area 74 is reached, at which time the debossed area functions as a fulcrum permitting the still connected panel section 82 to be bent rearwardly. As such, the customer may still drink from the container as is the case with the prior art constructions; however, the potentially dangerous panel section 82 will be retained in connection with the container and will be disposed of therewith.

It should be kept in mind, that the embodiments of FIGS. 9–13 may employ score-line constructions such as known in the prior art, or alternately they may utilize the score-line construction of FIGS. 1–5. Quite clearly, because of the advantages afforded by the novel score-line construction of Said FIGS. 1–5, this would be preferred.

Figure 14:
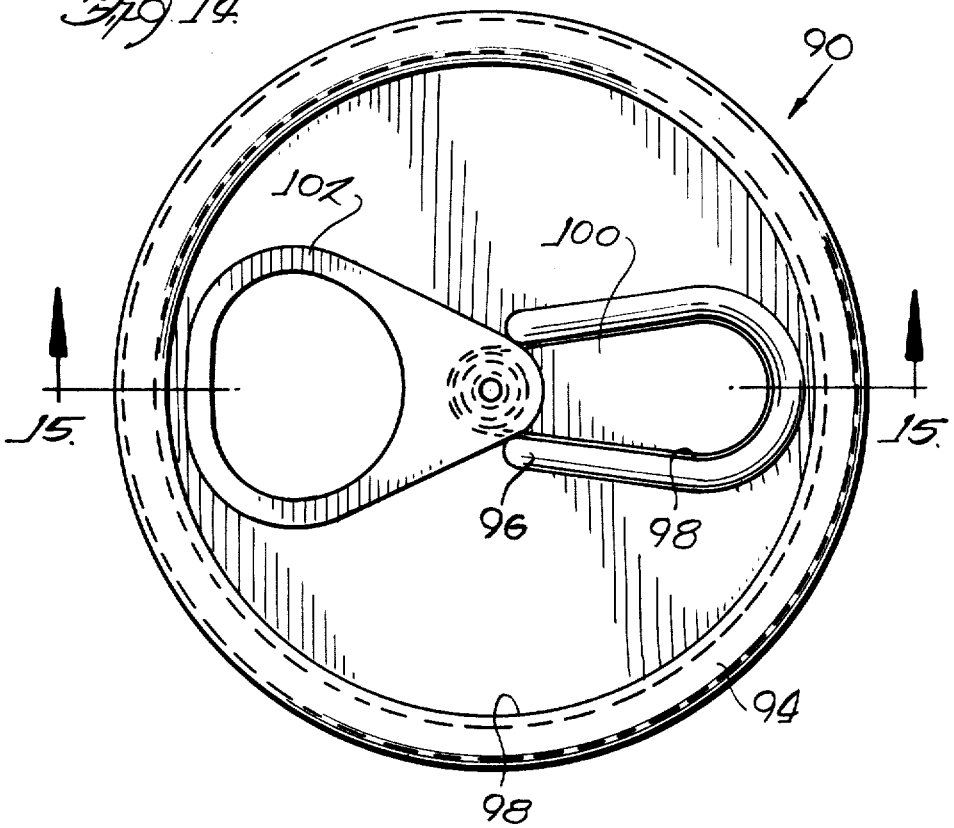
FIG. 14 is a top plan view of still another form of the invention illustrating a container end having a displaceable panel section of the key-hole type, with a raised rim disposed about the major portion of the periphery thereof.
Figure 15:
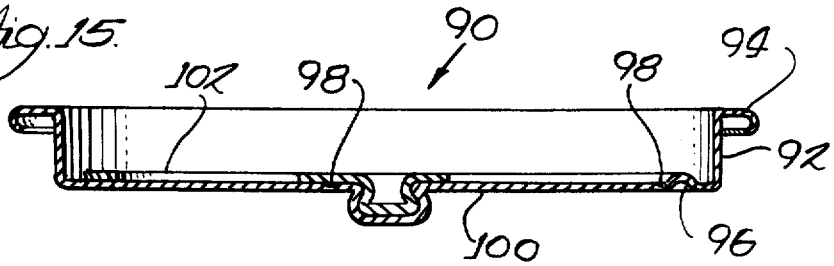
FIG. 15 is a sectional view taken along the line 15—15 of FIG. 14.
Figure 16:
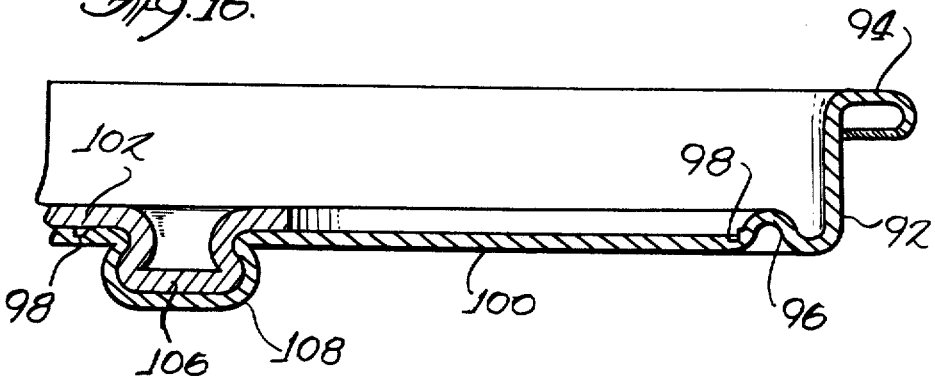
FIG. 16 is an enlarged, partial sectional view of the container end of FIG. 15, illustrating the disposition and shape of the score-line.

In FIGS. 14–16, still another novel end construction is illustrated, which is designated generally 90. The end 90 is of the type designed to be joined to a cylindrical can body (not shown) by roll-seaming or the like. As such, the end 90 includes an upwardly extending rim or flange 92 having a curl lip 94 formed integral therewith. During assembly, the lip 94 is engaged with the open end of a cylindrical can body to close an end thereof.

Formed in the upper surface of the end 90 is raised or embossed area 96. Immediately adjacent the inner peripheral edge of the embossed area 96, there is provided a score-line 98 which traverses a closed loop to define a removable panel section 100. As can be seen from the drawing, the removable panel section 100 is of the key-hole type, frequently employed with beverage and liquid containers of various types. A pull tab device or member 102 is attached to the panel section 100 at the narrow end thereof to facilitate opening of the container.

The manner of attaching the pull tab device 102 to the panel section 100 is best illustrated in FIGS. 15 and 16. In this regard, the pull tab member 102 is upset downwardly into the upper surface of the panel section 100 to provide a dimple which is nested within a correspondingly shaped recess formed in said panel section 100. The concentric formations thus obtained are then flattened, or cold headed, as illustrated to provide a blind end hollow rivet 106 engaged in a conforming boss 108, the latter being formed out of the material of the removable panel section 100. The headed configuration thus produced firmly secures the pull tab member 102 to the removable panel section, such that an opening force can be applied thereto.

With reference to FIG. 16, it is to be noted that the construction of the score-line 98 is preferably that as illustrated and discussed with regard to FIGS. 1–5. More specifically, the embossed area 96 is disposed immediately adjacent the score-line 98, so as to provide an area of relatively stiff, unflexible material outward of the score-line, and the perpendicular wall surface thereof. Accordingly, recalling the previous discussion pertaining to FIGS. 1–5 and the function of the return bend rim 50, the embossed area 96 serves generally the same purpose during the opening operation. That is, upon formation of the score-line 98 a zone of compacted material is produced immediately below the base wall thereof, with said zone terminating in alignment with the generally perpendicular outer peripheral wall of the score-line. Thus, when an opening force is applied to the displaceable panel section 100, the material immediately outward of the score-line 98 will not flex appreciably. As such, a shearing action is promoted during fracture along the outer periphery of the zone of compacted material which reduces the tendency of the path of fracture to traverse the base wall surface of the score-line 98. Thus, with the end construction as illustrated in FIGS. 14–16, the formation of burrs or the like on the edge of the opening and the removable panel section 100 are reduced.

Figure 18:
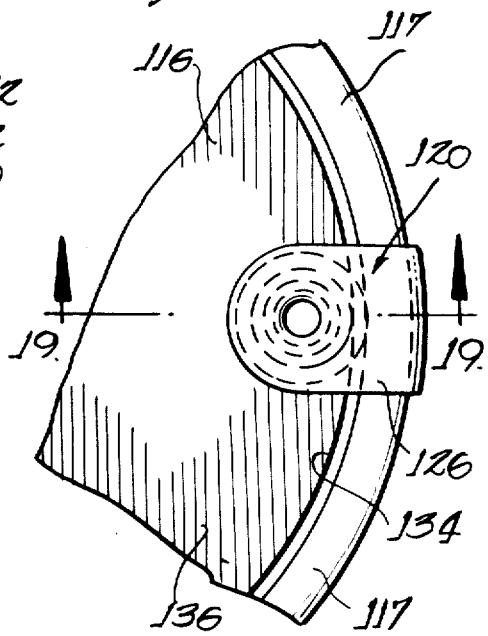
FIG. 18 is a partial, top view of the container of FIG. 17.
Figure 19:
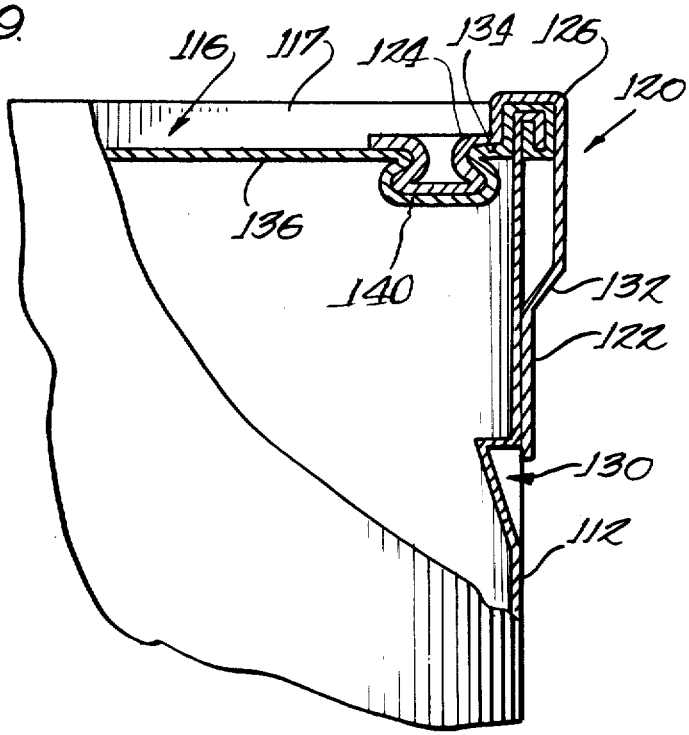
FIG. 19 is an enlarged, fragmentary sectional view taken through the container of FIG. 17.

In FIGS. 17–19 a novel form of can construction is illustrated, which is capable of being employed with any of the features discussed previously. With reference to FIG. 1, it should be noted that the can construction illustrated therein is of the drawn type wherein a pull tab device 38 is connected to a displaceable panel section formed in an integral or unitary end portion of the can body. The can construction contemplated pursuant to the invention of FIGS. 17–19 pertains to the more conventional type of can wherein separable end members are attached to opposite ends of a tubular or cylindrical body section. More specifically, the invention of FIGS. 17–19 provide an arrangement wherein a pull tab device of the type illustrated in FIG. 1 can be employed with the more conventional type of can construction.

The incomplete can construction of FIGS. 17–19, which is generally designated 110 is comprised by the tubular body 112 having an open end portion 114 with a separable end element 116 attached to the opposite end thereof by a roll-seaming operation, or the like.

It should be noted, that upon attachment of the end 116 to the body 112, a continuous raised rim 117 is provided about the entire periphery of the container end portion. Heretofore, this raised rim 117 necessitated that the pull tab device employed be of a relatively conventional design, i.e., as illustrated in FIG. 14, wherein said device lay in a plane substantially parallel to the upper surface of the end member. Accordingly, during opening the pull tab device had to be lifted or pivoted about the point of attachment to the displaceable panel section in order to produce initial fracture of the score-line. This operation caused a segment of the panel portion to be forced inwardly. Once initial fracture was accomplished by inward bending, the panel section had to be bent in a reverse direction in order to affect a complete fracture of the score-line and removal of said panel section from the end.

The disadvantages inherent with this type or mode of opening are numerous. The reverse bending operation requires an excessively high opening force, especially noticeable with larger size cans. Also, undue strain was placed on the rivet attaching the pull tab device to the panel section which often resulted in failure prior to completion of the opening process. As will be appreciated from the following discussion, the disadvantages inherent with the prior art constructions are overcome, or obviated to some degree by the invention illustrated in FIGS. 17–19.

With reference to FIGS. 18 and 19, the pull tab arrangement of the present invention is illustrated in detail and designated generally 120. The device 120 is designed such that it may be mounted on a separable type of container end after attachment of said end to a container body by a roll-seaming operation. Toward this end, the design or shape of the pull tab device 120 is such as to accommodate the rim or chime 117 formed during the roll seaming operation.

More specifically, the pull tab device 120 is of a generally L-shaped or right angle configuration and include a vertical segment 122, a generally horizontal arm segment 124 disposed in overlying relation to the upper surface of the end 116, and a bight section 126 joining the horizontal and vertical sections 122 and 124. The vertical segment 122 extends coaxially of the container body 112, which body may be indented, as shown, at 130, to facilitate grasping of the free end of said segment 122. Alternately, the free end of the segment 122 may be flaired outwardly. In the illustrated form of the invention, the vertical segment 122 is connected to the bight portion 126 by a tapered segment 132.

It is clearly seen, from FIG. 19, the bight section 126 extends upwardly from the vertical segment 122 and overlies the rim or chime 117 of the can construction 112. The point of merger of the bight section 126 with the horizontal arm 124 is near the point of attachment of said arm 124 to the container end portion.

A frangible score-line 134 is formed in the upper surface of the end portion 116, as is required for opening, which traverses a closed loop, thereby defining a displaceable panel section 136. Here again, the design or nature of the score line 134 may be of the conventional type known in the art, or that as disclosed previously with regard to FIGS. 1–5, the latter being preferred.

A desired method for attaching the horizontal arm segment 124 to the can end, and more specifically to the displaceable panel section 136 is illustrated in FIG. 19. This method is essentially that as illustrated and described with regard to FIGS. 15–16, and as such will not be discussed in detail except that the cold headed rivet thus formed is designated 140.

Upon opening, the vertical segment 122 of the pull tab member 120 is grasped and is pivoted upwardly and outwardly. The member 120 is formed from a heavier gauge material than that of the can end portion, or is strengthened in some other manner, so as to render it relatively stiff. Accordingly, during opening, the entire pull tab device 120 remains substantially rigid, thereby transmitting the upwardly directed force to the displaceable panel section 136 via the rivet connection 140. The application of an upwardly directed force will cause the score-line 134 to fail or fracture in shear. The continued application of an upwardly directed force will produce further displacement of the panel section 136, and correspondingly continued fracture of the score-line 134, until the panel section 136 is completely removed.

From the above, it should be noted that the opening of the container construction illustrated is characterized by the continuous upward movement of the displaceable panel section 134. This should be compared with the prior art approach, wherein this panel section must be first bent inwardly to produce initial fracturing of the score-line, and then bent in a reverse direction in order to produce continued fracturing and removal thereof. As such, with the present invention, the opening forces required are reduced, as is the danger of disengagement of the pull tab member 120 prior to completion of the opening operation.

While the applicant has illustrated and described preferred constructions and methods of fabrication pertaining to his inventions, it is realized that those skilled in the art may devise alternate structures or procedures, which may fall within the spirit and scope of the said inventions, as defined by the claims appended hereto.

The invention is claimed as follows:

1. A container construction for vacuum packed products, having a pull tab opening device and comprising: a body section and an end portion closing one end of said body section, said end portion including a panel section to which said pull tab device is attached, said panel section being defined by a score-line which includes a weakened, frangible base wall section, said end portion including a debossed area with said score-line terminating at spaced points on the periphery of said debossed area, such that during opening, fracture of said frangible base wall section will terminate at said debossed area, with said debossed area providing a fulcrum point for bending of the panel section upon the continued application of opening forces, thereby inhibiting complete removal of said panel section from said end portion, and an indicator device on said end portion which is in a first condition when the vacuum has been maintained in the container and in a second condition when the vacuum has been broken.

2. A container construction as in claim 1 wherein the indicator device comprises a domed-shaped section which is withdrawn inwardly when the vacuum is created within the container, and the dome-shaped section concaving outwardly when the vacuum is broken.

3. An end portion for a container construction for vacuum packed products having a pull tab opening device secured thereto and which is designed for attachment to a container body section for closing an end of said section, said end portion including a panel section to which said pull tab opening device is attached, said panel section being defined by a score-line formed in said end portion and including a weakened, frangible base wall section, and a debossed area with said score-line terminating at spaced points on the periphery of said debossed area, such that during opening of a container, fracture of said frangible base wall section will terminate at said debossed area, with said debossed area providing a fulcrum point about which the panel section will bend upon the continued application of opening force, thereby inhibiting random shearing of said end portion which would enable removal of said panel section, and a vacuum indicating device on said end portion.

4. An end portion as in claim 3 wherein the indicator device comprises a domed-shaped section which is withdrawn inwardly when the vacuum is created within the container, and the dome-shaped section concaving outwardly when the vacuum is broken.

* * * * *